US006910718B2

(12) United States Patent
Chareas et al.

(10) Patent No.: US 6,910,718 B2
(45) Date of Patent: Jun. 28, 2005

(54) WRITING PAD FOR CELLPHONE

(76) Inventors: Nick Chareas, P.O. Box 59204, Schaumburg, IL (US) 60159; Kathryn Chareas, P.O. Box 59204, Schaumburg, IL (US) 60159

( * ) Notice: Subject to any disclaimer, the term of this patent is extended or adjusted under 35 U.S.C. 154(b) by 0 days.

(21) Appl. No.: 10/722,516

(22) Filed: Nov. 28, 2003

(65) Prior Publication Data

US 2004/0113417 A1 Jun. 17, 2004

Related U.S. Application Data

(63) Continuation-in-part of application No. 10/317,188, filed on Dec. 12, 2002, now abandoned.

(51) Int. Cl.[7] ..... B42D 17/00

(52) U.S. Cl. ..... 281/44; 281/51; 445/550.1; D19/36

(58) Field of Search ..... 281/44, 45, 51; D19/36; 445/550.1, 567

(56) References Cited

U.S. PATENT DOCUMENTS

| | | | | | |
|---|---|---|---|---|---|
| 1,612,258 | A | * | 12/1926 | Broadwin | 281/12 |
| 3,052,056 | A | | 9/1962 | Eisenstein | |
| 4,752,949 | A | | 6/1988 | Steinbeck et al. | |
| 5,324,076 | A | * | 6/1994 | Nieradka | 281/45 |
| 5,348,347 | A | | 9/1994 | Shink | |
| 5,901,223 | A | | 5/1999 | Wicks et al. | |
| 5,933,783 | A | | 8/1999 | Kawakami et al. | |
| D438,564 | S | | 3/2001 | Green | |
| 6,427,078 | B1 | | 7/2002 | Wilska et al. | |
| 2002/0089817 | A1 | | 7/2002 | Eisenbraun | |
| 2002/0158129 | A1 | * | 10/2002 | Hu | 235/462.11 |
| 2002/0180205 | A1 | * | 12/2002 | Anderson | 281/45 |
| 2004/0113417 | A1 | * | 6/2004 | Chareas et al. | 281/44 |

* cited by examiner

*Primary Examiner*—Monica S. Carter
(74) *Attorney, Agent, or Firm*—Richard C. Litman

(57) ABSTRACT

A writing pad attachment for a cellular phone or other handheld electronic device, having a housing, an adjustable writing surface, a marking pad and a writing implement. The housing is releasably attached to the back of a cellular phone. The adjustable writing surface is located inside of the housing and is slidably adjusted to a locked position outside of the housing to provide a sturdy writing surface. Alternatively, the adjustable writing surface may be released from the housing and placed in a more convenient location. The adjustable writing surface is either a tray or a flat slate. The housing may be detached from the back of the cellular phone to provide a more convenient writing surface for the user. The writing pad attachment also provides a locking mechanism for securing the adjustable writing surface in a desired position.

13 Claims, 15 Drawing Sheets

WRITING PAD FOR CELLPHONE

CROSS REFERENCE TO RELATED APPLICATIONS

This application is a continuation-in-part of application Ser. No. 10/317,188 filed Dec. 2, 2002 now abandoned.

BACKGROUND OF THE INVENTION

1. Field of the Invention

The present invention relates to accessories for portable electronic devices, and more particularly, to attachable notepads and writing implements for cellular phones.

2. Description of the Related Art

Portable cellular phones have become widely available and very popular for personal use. Cellular phones are most commonly used while the user is outside of his home or office. Many problems may arise while a cellular phone is used in this manner. A cellular phone may be easily damaged, a cellular phone may be easily misplaced or lost and the user does not have the ability to take down notes or phone numbers while out in public. It is extremely difficult to take down messages while using a cell phone outside of the office or home. Taking down notes while on the cellular phone requires you to carry a pen and notepad. It is also difficult to find a suitable surface to rest the notepad while writing down the notes. To alleviate these problems many cellular phone accessories are being widely produced.

The term "cellular phone" is meant to include traditional cell phones as well as newer phones including digital screens, built-in computer(s), Internet connection devices, cordless telephones and other add-ons that are becoming more popular as parts of the basic cellular phone.

Certain examples of accessories that are representative of the cellular phone industry are disclosed in U.S. Patent Application Publication No. 2002/0089817 to Eisenbraun, U.S. Pat. No. 5,348,347 to Shink and U.S. Pat. No. D438, 564 to Green. Green discloses an ornamental design for a combined cellular phone pen and pen holder. The pen holder is attached to the side of the cellular phone and is adapted to receive a writing implement. Eisenbraun describes a keypad protector that includes a battery compartment cover adapted to secure over the battery compartment of a portable electronic device having a keypad, such as a cellular phone, and a flap attached to the cover that pivots to protect the keypad. Eisenbraun teaches that the keypad protector may provide a surface suitable for storage of a notepad or other thin sheet materials. Shink discloses a pocketbook size organizer that can store a portable cellular phone. The organizer comprises a flexible book that is folded into a closed position. The book contains a hook for securing a cellular phone inside the organizer. The book further contains attachment means for receiving other accessories such as a pen, notepad or calculator.

U.S. Pat. No. 6,427,078 to Wilska discloses a wireless communication device including a housing having a cellular telephone and a pen for writing text of a viewing screen of a digital pad. U.S. Pat. No. 4,752,949 to Steinbeck et al. discloses a telephone that may be used as a cordless telephone or as a standard corded telephone. U.S. Pat. No. 3,052,056 to Eisenstein discloses a telephone accessory that is secured to the bottom of a telephone. The accessory comprises a flat slate that is adjustably mounted to the bottom of a tabletop telephone. The slate is secured to the telephone by a mounting portion and is slidably adjustable in relation to the mounting. A writing pad is disposed on top of the flat slate and is secured underneath the telephone. U.S. Pat. No. 5,901,223 to Wicks et al. discloses a wireless telephone unit having a pivoting extension mounted to the side of the telephone. The extension is used as a place to provide a variety of peripheral devices. U.S. Pat. No. 5,933, 783 to Kawakami et al. discloses a portable communication device having an integral display panel that allows the user of the device to take down notes while using the communications device.

A problem exists with the cellular phone accessories presently in the field in that they do not provide the user with a convenient means for writing down messages. The existing note-taking accessories for cellular phones are not easily concealable when not being used. Many of the existing accessories are rather bulky and they do not provide a sturdy surface for writing down notes. None of the existing accessories provide an adjustable writing surface that is capable of being securely locked into desired positions.

Therefore, what is needed is a writing pad accessory that is easily attachable to a cellular phone. What is further needed is an adjustable tray or slate writing surface that can be locked into place or can be released from the writing pad accessory and placed on a secure surface. What is still further needed is a writing pad accessory with an adjustable tray or slate writing surface that can be stored inside of the writing pad accessory while not in use. What is still further needed is a writing pad accessory with a small, lightweight and inexpensive housing unit that can come in any color and fit any cellular phone device. What is still further needed is a writing pad accessory that provides a means for taking down temporary notes or messages to be used later and then conveniently discarded without having to waste paper for each note taken. What is still further needed is a writing pad accessory with a housing unit for the tray or slate writing surface that can be used to efficiently store the marking pad and writing implement. Additionally, what is needed is a writing pad accessory that may be concealed from view while not in use.

None of the above inventions and patents, taken either singularly or in combination, is seen to describe the instant invention as claimed. Thus a writing pad for cellular phone solving the aforementioned problems is desired.

SUMMARY OF THE INVENTION

The present invention is a writing pad attachment meeting some or all of the needs mentioned above. The writing pad attachment of the present invention provides a sturdy writing surface for taking down notes while the user is operating a cell phone or other handheld electronic device. Preferred embodiments of the present invention comprise a housing, an adjustable writing surface, a marking pad and a writing implement. The housing is releasably attached to the back of any common cellular phone or handheld electronic device. The housing provides an access opening that is adapted to receive the adjustable writing surface. The adjustable writing surface is located inside of the housing, and can be moved to a position outside of the housing. Once the writing surface is adjusted to the position outside of the housing it locks into position to provide a sturdy writing surface. The writing surface may also be released from the housing and placed on a more secure surface for the convenience of the user.

In accordance with one aspect of the present invention the adjustable writing surface is in the form of a tray. The marking pad is located on the top surface of the adjustable writing surface. The marking pad and the writing implement are stored with the adjustable writing surface inside of the housing while not in use.

In accordance with another aspect of the present invention the writing pad attachment includes a housing that is releasably mountable to a wireless device having at least a top surface, at least two closed sides forming an access opening in the housing, and a bottom lip portion disposed along each of the closed sides and an adjustable support tray slidably disposed in the housing and supported by the bottom lip portions. The writing pad attachment also includes a support tray locking mechanism for releasably locking the support tray in one of the at least two positions. The locking mechanism has a plurality of lock projections disposed on each end of the bottom lip portions on the housing, and a plurality of lock recesses, adapted for releasably receiving the lock projections, disposed on each end of each mounting groove on the support tray.

Accordingly, it is a principal object of the invention to provide a writing pad attachment that is easily attached to, and detached from, a cellular phone.

It is another object of the invention to provide a convenient and reliable means for writing down notes while using a cellular phone in any location.

It is a further object of the invention to provide a flat, sturdy writing surface for taking down notes.

Still another object of the invention is to provide a writing pad accessory that may be concealed from view while not in use.

Still another object of the invention is to provide a releasable tray or slate writing surface that can be locked into place or released from the housing to provide a sturdier or more convenient writing surface.

Still another object of the invention is to provide a small, lightweight housing that may fit any cellular phone or other handheld electronic device.

Still another object of the invention is to provide a means for taking down temporary notes or messages that may be easily discarded without wasting paper.

Still another object of the present invention is to provide a housing unit with a compartment for storing the writing surface, the marking pad and the writing implement.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
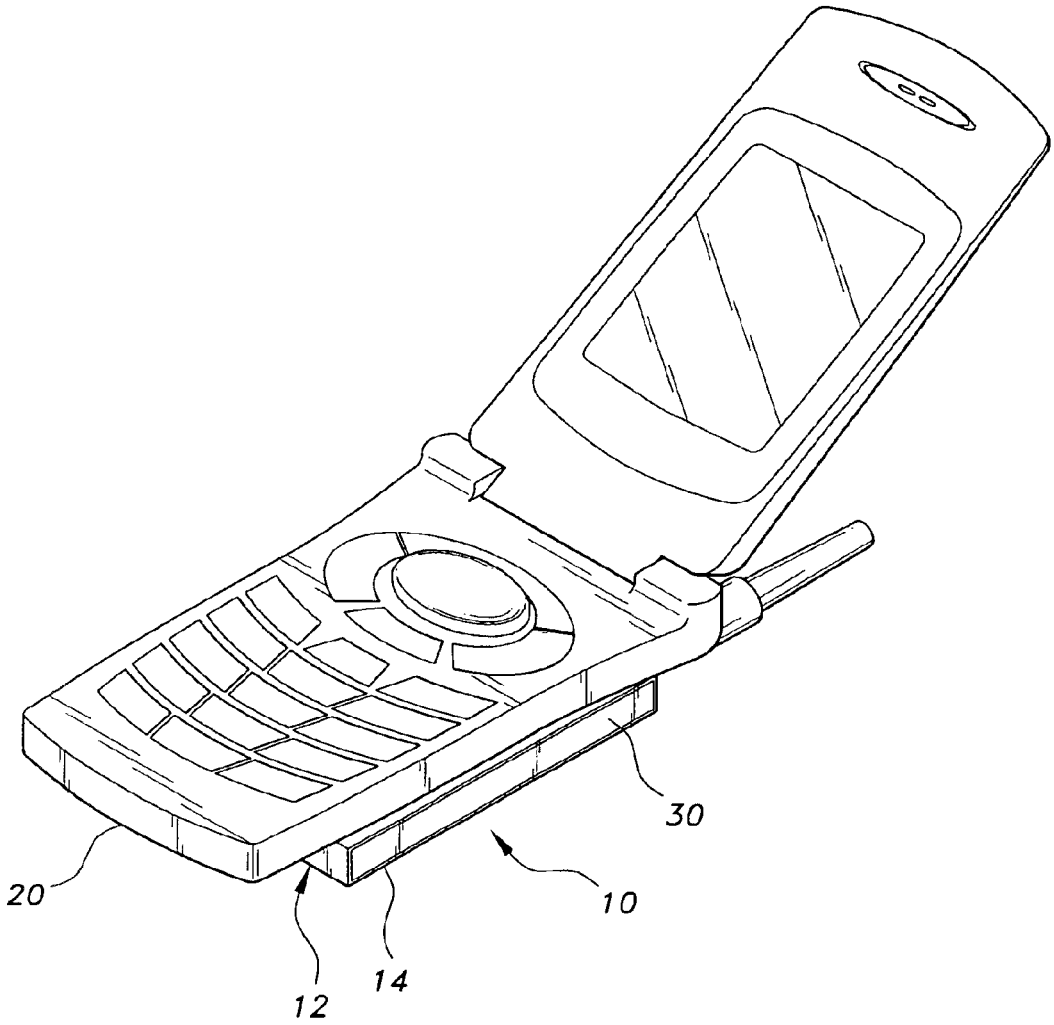
FIG. 1 is an environmental, perspective view of a writing pad attachment for a cellular phone according to the present invention.

FIG. 1 is a perspective view of the writing pad attachment 10 for a cellular phone. The writing pad attachment 10 is not limited to being used with a cellular phone and may be used with any handheld electronic device. The housing 12 of the writing pad attachment 10 is releasably attached to the rear of the cellular phone 20. In preferred embodiments of the present invention the housing 12 is releasably attached to the rear of the cellular phone 20 using either VELCRO (hook and loop fastener) or an adhesive. The housing 12 is not limited to being attached in this manner and may be attached using anything that will allow the housing to be easily removed and reattached to the cellular phone 20. The housing 12 has an open end 14 adapted for receiving an adjustable writing surface 30. The housing 12 can be made from any suitable material that is both lightweight and sturdy, e.g, a suitable plastic.

Figure 2:
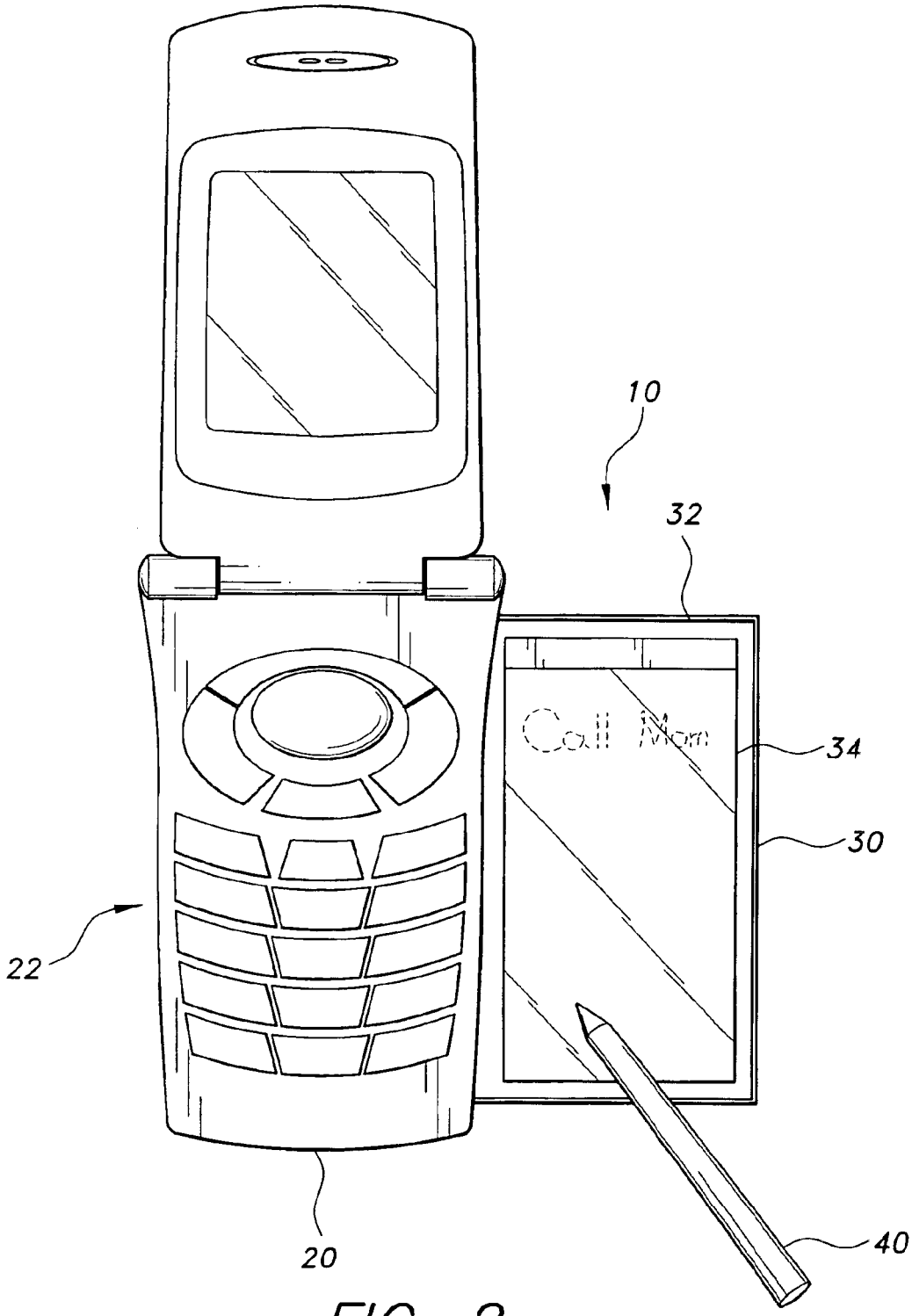
FIG. 2 is a front view of one embodiment of the writing pad attachment depicted in FIG. 1.

In FIG. 1 the adjustable writing surface 30 is shown in a stored position inside of the housing 12. The adjustable writing surface 30 can be slid from this stored position to an open position outside of the housing 12. FIG. 2 depicts a front view of the present invention where the adjustable writing surface 30 is in the open position. The housing 12 is located on the rear surface 22 of the cellular phone 20. The adjustable writing surface 30 is locked in an open position outside of the housing 12. The adjustable writing surface 30 can be locked into position using any standard locking mechanism known to those skilled in the art. If a sturdier or more convenient writing surface is required the adjustable writing surface 30 may be released from the housing 12 and placed on a more secure location.

In the embodiment depicted in FIG. 2, the adjustable writing surface 30 is a tray with outer wall 32 located around the top, the bottom and the outer side of the adjustable writing surface 30. In other embodiments, the adjustable writing surface 30 is a flat slate that does not have the outer wall 32. In the locked, open position the adjustable writing surface 30 provides a convenient and sturdy surface for taking down notes while the user is on the cellular phone 20. In embodiments using a flat slate adjustable writing surface 30, the adjustable writing surface 30 must be lifted so that it is flush with the top of the cellular phone 20 to provide a more convenient writing surface, before it is locked into position. The adjustable writing surface 30 is made from any material known in the art that is suitable for providing a sturdy writing surface.

FIG. 2 further depicts a marking pad. In the present embodiment depicted in FIG. 2 the marking pad 34 is a magic pad. The magic pad is a note-taking pad with a top plastic layer. The present invention also includes a writing implement 40. In this preferred embodiment the writing implement 40 used to make marks on the magic pad is a stylus. The magic pad is convenient for making temporary notes. Once the notes are no longer needed the user lifts the top layer of the magic pad and the notes are erased.

Figure 3:
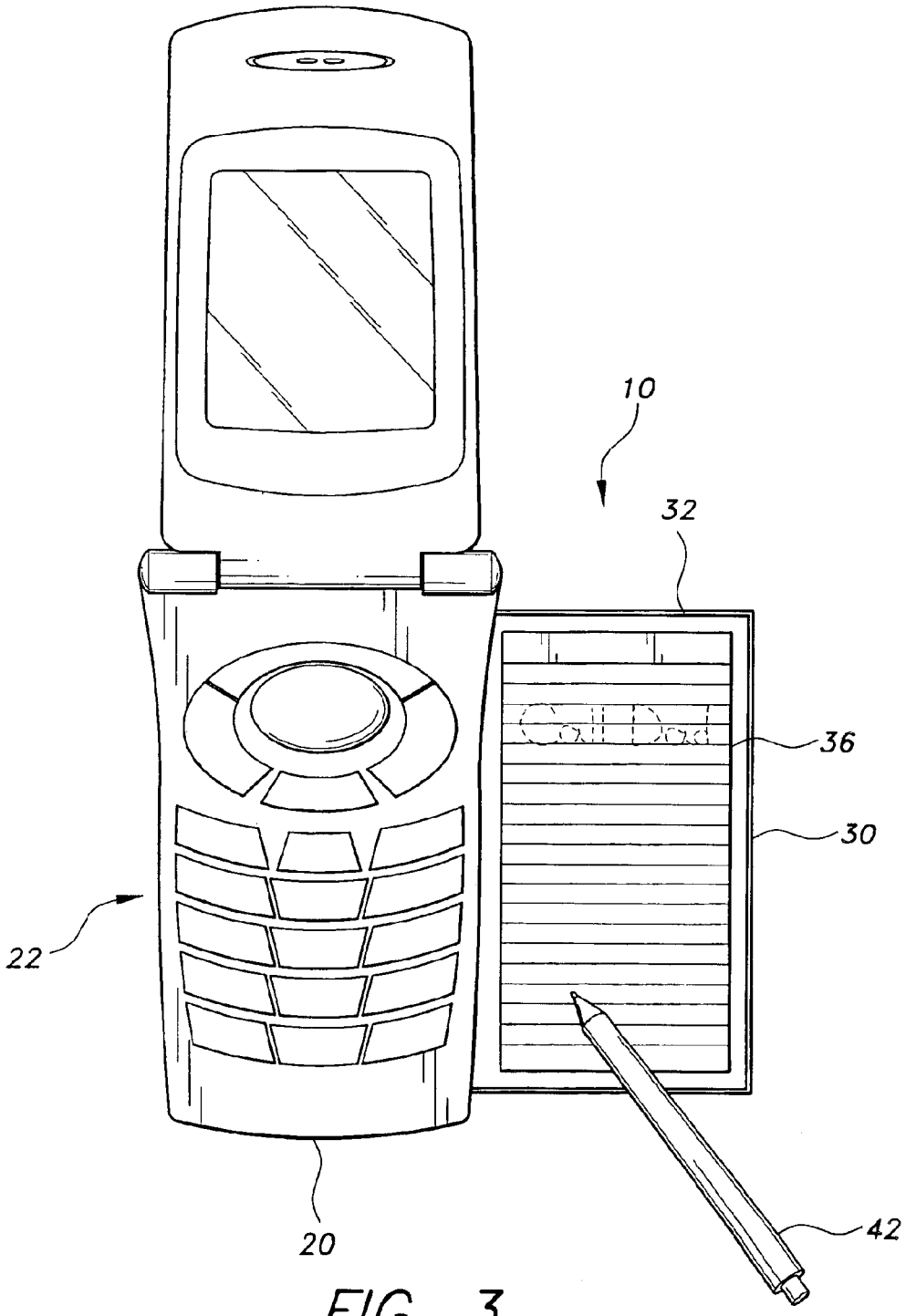
FIG. 3 is a front view of a second embodiment of the writing pad attachment depicted in FIG. 1.

FIG. 3 depicts another embodiment of the present invention. In this embodiment the marking pad 36 is a paper notepad. The paper note pad is convenient for when the user desires permanent notes. In the embodiment depicted in FIG. 3 the writing implement 42 provided for writing notes on the paper notepad is an ordinary pen. The magic pad and the paper notepad are interchangeable.

The marking pads 34, 36 and the writing implements 40, 42 are stored on the adjustable writing surface 30 inside of the housing 12. In the particular embodiments where the adjustable writing surface 30 is a tray, the marking pads 34, 36 are secured on the adjustable writing surface 30 by the outer wall 32, or by a suitable adhesive. In the particular embodiments where the adjustable writing surface 30 is a flat slate, the flat slate can be either completely flat or provided with beveled edges. If the flat slate has beveled edges the edges will secure the marking pads 34, 36 to the adjustable writing surface 30. If the flat slate is completely flat an adhesive will be used to secure the marking pads 34, 36 to the adjustable writing surface 30.

Figure 4:
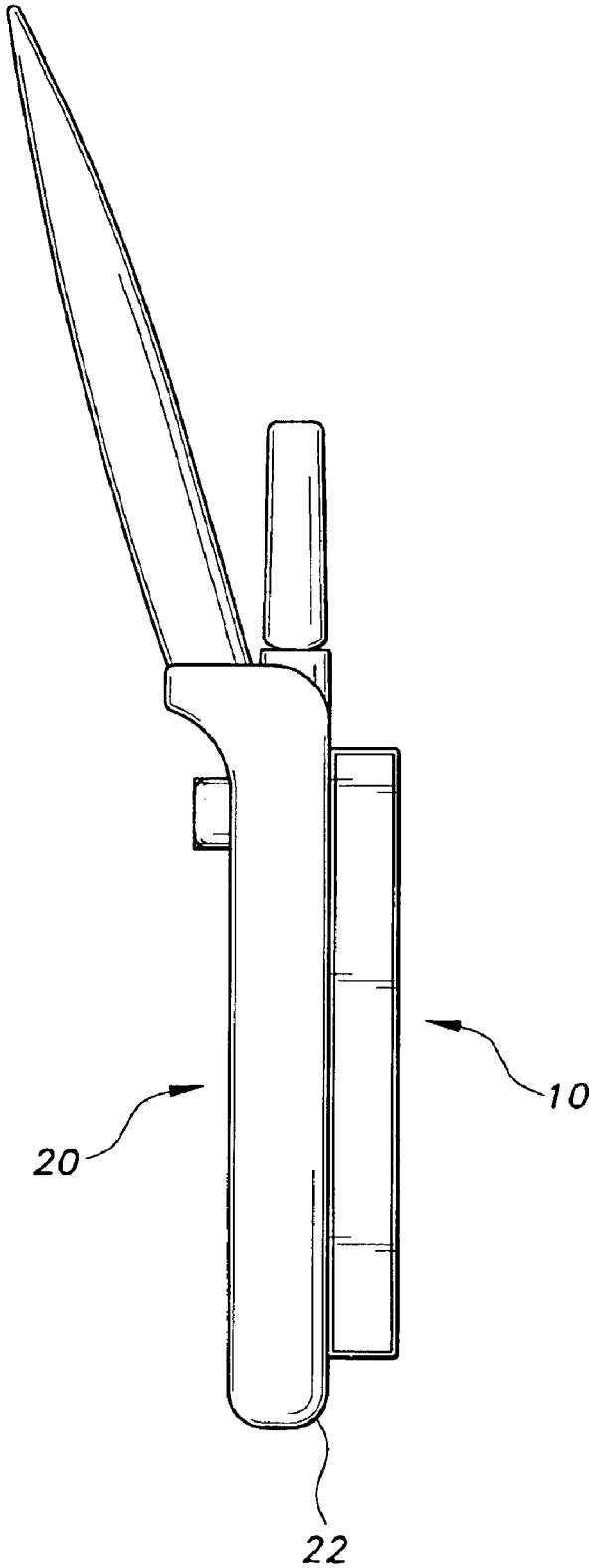
FIG. 4 is a side view of the writing pad attachment depicted in FIG. 1.
Figure 5:
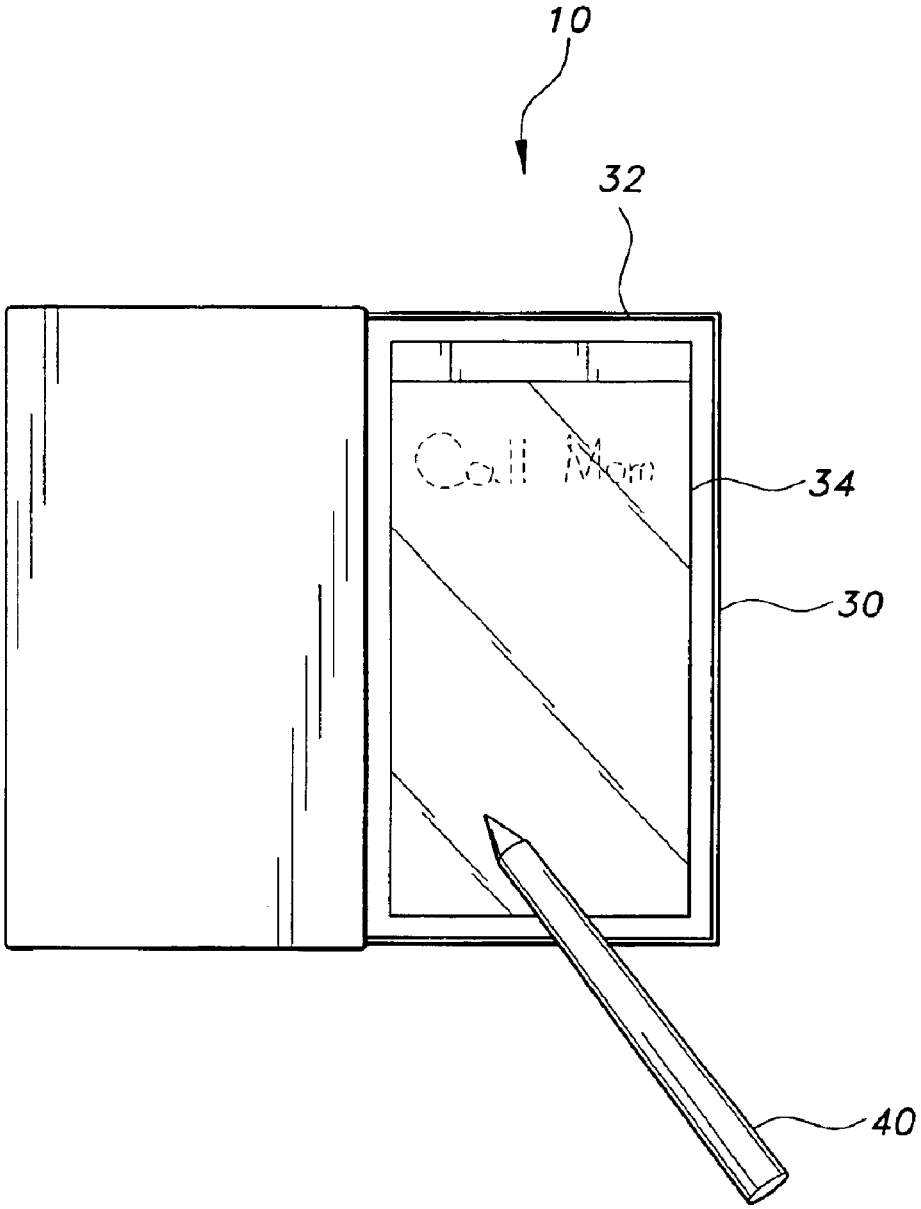
FIG. 5 is a perspective view of the writing pad attachment detached from the cellular phone.

FIG. 4 depicts a side view of a preferred embodiment of the present invention. The writing pad attachment 10 is releasably secured to the rear 22 of the cellular phone 20 using a releasable adhesive, such as VELCRO (hook and loop fasteners). In this attached position the writing pad attachment 10 provides a sturdy surface for taking notes while on the cellular phone 22. FIG. 5 depicts the writing pad attachment 10 detached from the cellular phone 20. If a more convenient location is required for writing notes while on the cellular phone, the slate or the writing pad and its tray may be removed from the cellular phone 20 and the housing 12, and placed on a table or other sturdy surface for more convenient writing.

Figure 6:
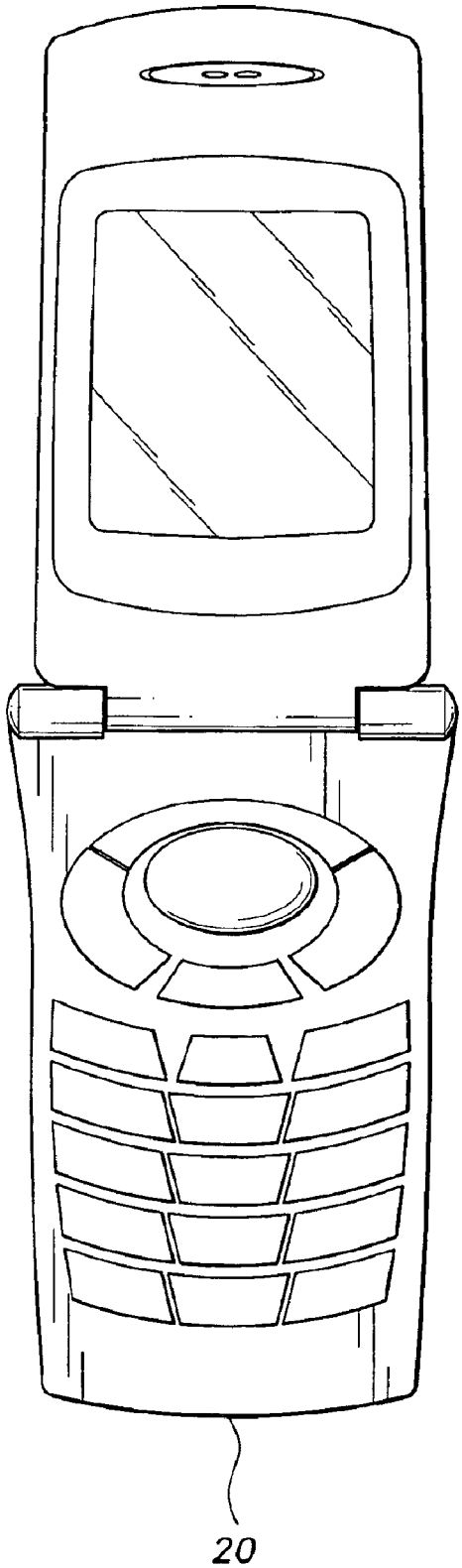
FIG. 6 is a front view of a cellular phone.

A primary objective of the present invention is to provide a writing pad attachment 10 for cellular phones that is convenient and sturdy for the user. Another objective of the present invention is to provide a writing pad attachment 10 that may be concealed from view when not in use. FIG. 6 depicts a front view of the cellular phone 20 with the adjustable writing surface 30 in its stored position. FIG. 6 demonstrates that the writing pad attachment 10 is concealed from view when the adjustable writing surface 30 is stored inside of the housing 12.

Figure 7:
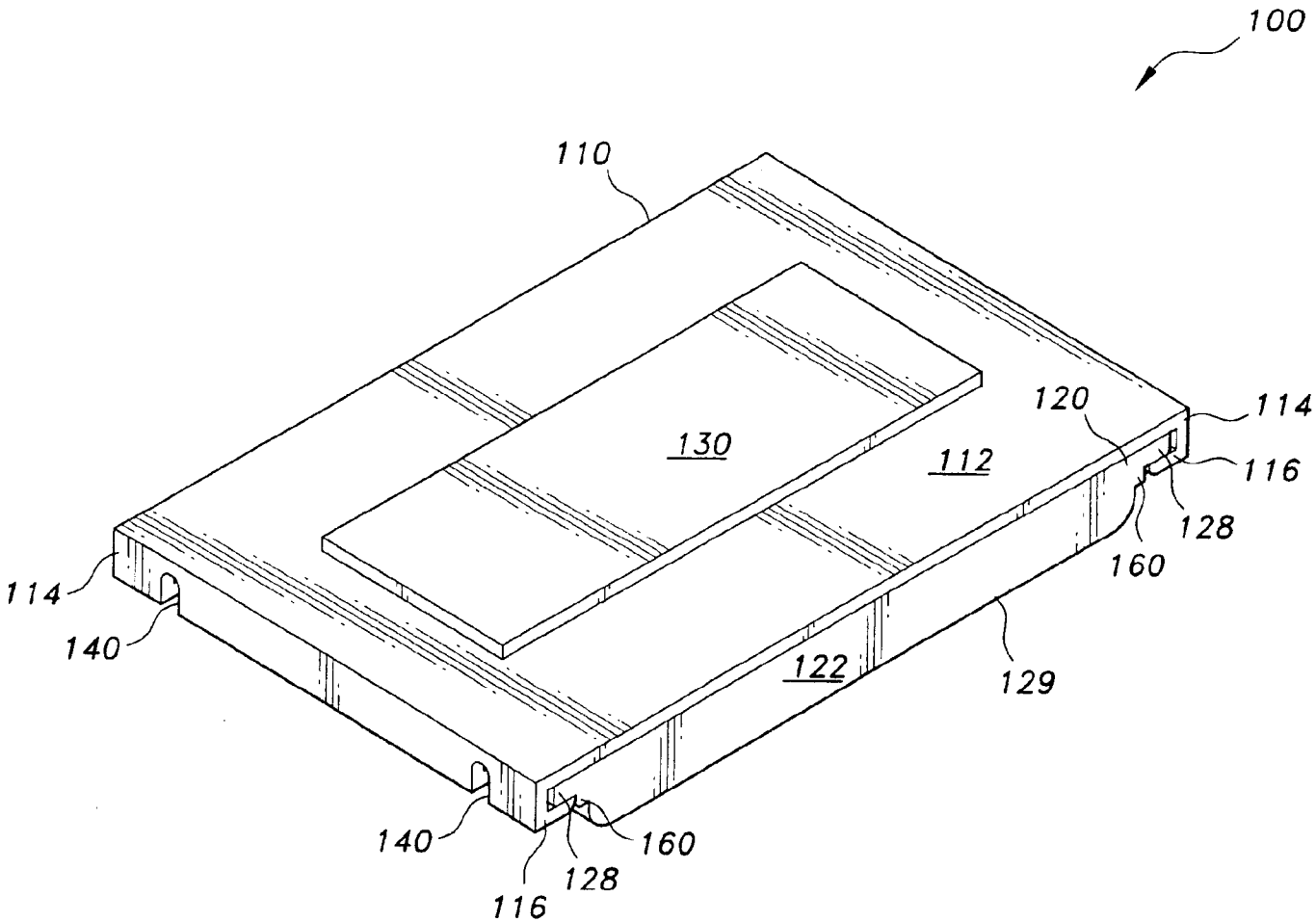
FIG. 7 is a top perspective view of a writing pad attachment according to the preferred embodiment of the present invention.
Figure 8:
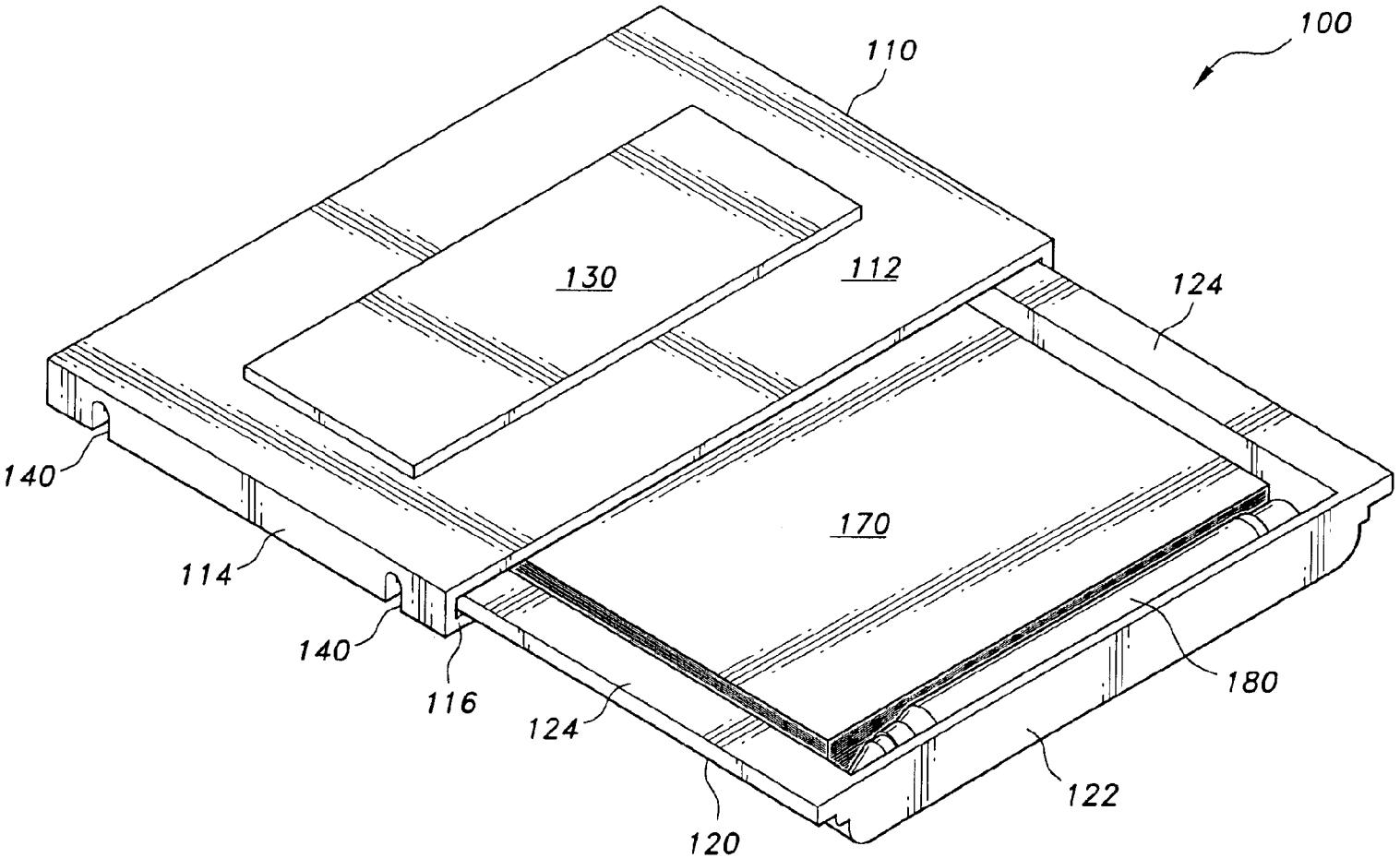
FIG. 8 is a top perspective view of the preferred embodiment of the writing pad attachment in an open position.

FIG. 7 depicts a writing pad attachment 100 according to a preferred embodiment of the present invention. The preferred writing pad attachment 100 is releasably securable to the back of a cellular telephone or other handheld wireless communication device. The writing pad attachment 100 comprises a housing 110 and a slidably adjustable support tray 120. The support tray 120 is stored inside of the housing 110 (as shown in FIG. 7) and is adjustable to an open position (as shown in FIG. 8) outside of the housing 110.

Figure 14:
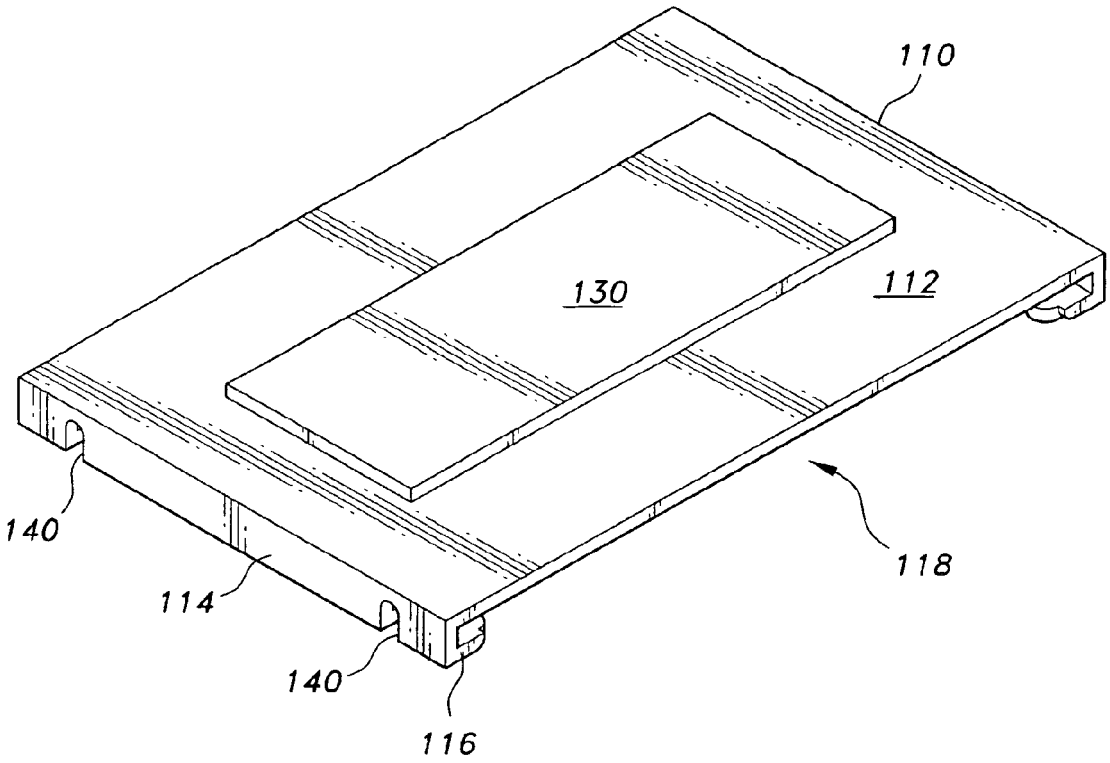
FIG. 14 is a top perspective view of the housing of the preferred writing pad attachment.

FIG. 14 is a top perspective view of the housing 110. The housing comprises a generally rectangular main body having a top surface 112 and a bottom surface 113 (shown in FIG. 9). The housing 110 comprises a pair of closed sides defined by side walls 114. The housing 110 provides a lip portion 116 disposed along the bottom of each side wall 114. The lip portions 116 extend along the entire length of the side walls 114. The housing 110 has open end portions that define an access opening 118 at each end of the housing 110 for receiving the support tray 120.

Figure 13:
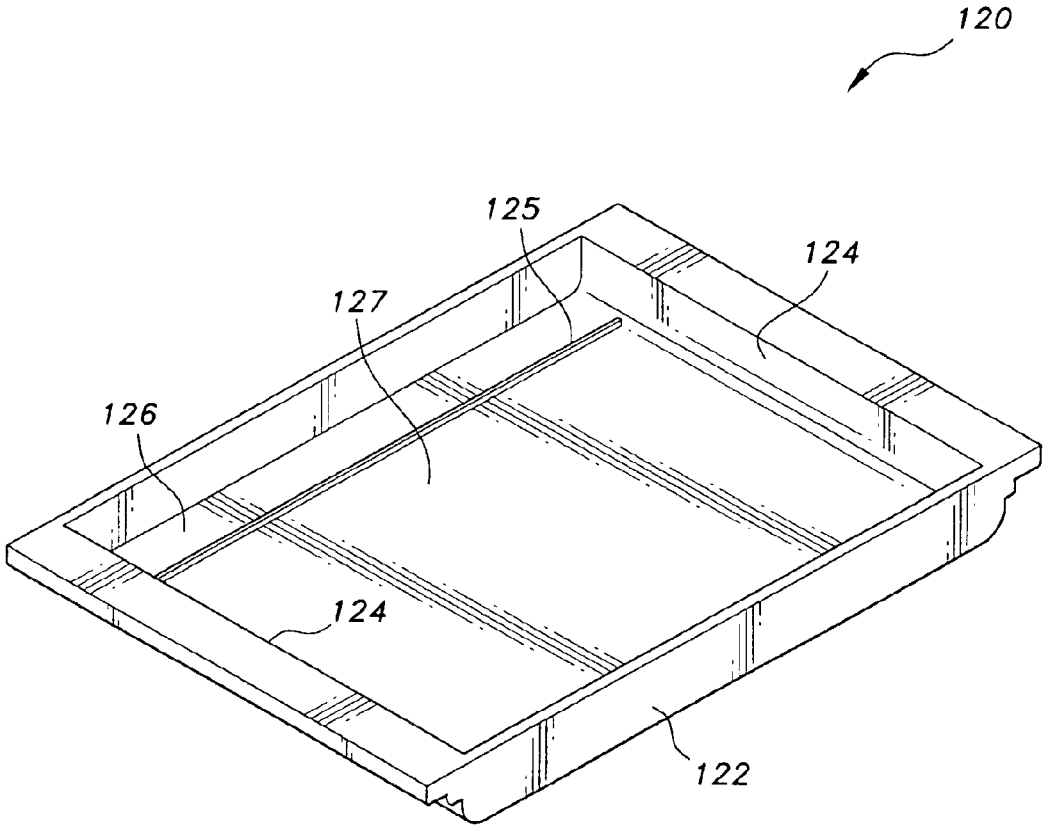
FIG. 13 is a top perspective view of the tray removed from the housing of the preferred writing pad attachment.

The support tray 120 is depicted in FIG. 13. The support tray 120 comprises a generally rectangular body having a bottom surface 129, a top surface and a plurality of end portions 122. The top surface provides an indented receiving portion 125 defining an interior portion of the support tray 120. The indented receiving portion 125 is defined by a plurality of side walls 124 that extend into the support tray 120. The receiving portion 125 has a writing implement portion 126 and a marking pad portion 127, which are each adapted to respectively retain a writing implement 180 and a marking pad 170 (as shown in FIG. 8) inside of the writing pad attachment 100.

Figure 10:
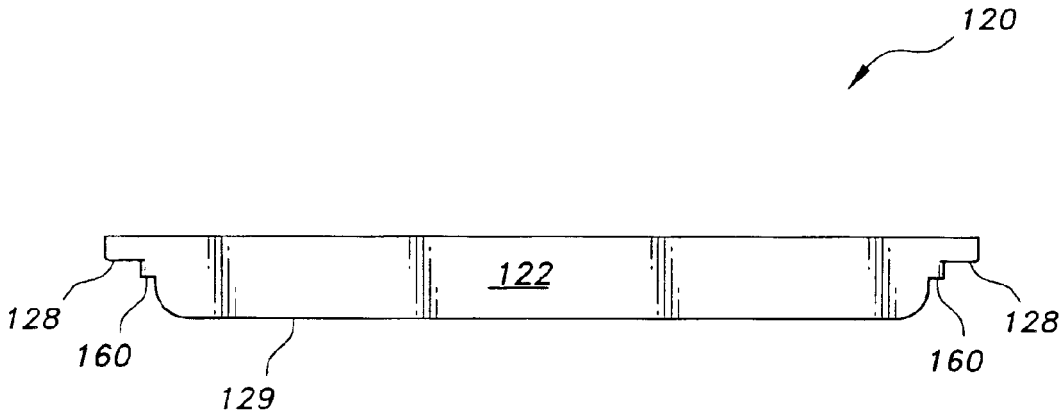
FIG. 10 is an end plan view of the tray of the preferred writing pad attachment.

FIG. 10 is an end view of the support tray 120. The support tray 120 has a groove on each side of the bottom surface 129. The grooves each define a projection portion 128 that extends along the entire length of the support tray 120. The projection portions 128 are adapted to engage the lip portions 116 of the housing 120. The projection portions 128 engage the lip portions 116 in a manner that allows the support tray 120 to slide in and out of the housing 110 while it is supported by the lip portions 116.

As shown in FIG. 7 and FIG. 14, a mounting member 130 is secured to the housing 110. The mounting member 130 is disposed along the top surface 112 of the housing 110 for releasably securing the housing 110 to the rear surface of a cellular telephone or other handheld, portable communications device. According to this preferred embodiment of the present invention, the mounting member 130 comprises a strip of double sided adhesive tape.

The writing pad attachment 100, as shown in FIG. 8, further comprises a marking pad 170 and a writing implement 180. The marking pad 170 and the writing implement 180 are retained inside of the receiving portion 125 of the support tray 120. The marking pad and the writing implement 180 are stored in the support tray 120 when the support tray 120 is closed inside of the housing 110. According to the present preferred embodiment, the marking pad 170 comprises a pad of paper and the writing implement 180 comprises a pen.

According to one aspect of the preferred embodiment, the support tray 120 of the writing pad attachment 100 is slidably adjustable into three positions. The first position is the stored position, shown in FIG. 7, where the support tray 120 is positioned inside of the housing 110. The second position is the open position, shown in FIG. 8, where the support tray 120 is positioned outside of the housing 110, revealing the marking pad 170 and the writing implement 180. The third position is shown in FIG. 13 where the support tray 120 is completely removed from the housing 110. The support tray 120 may be removed from the housing 110 and placed on a sturdy writing surface.

Figure 9:
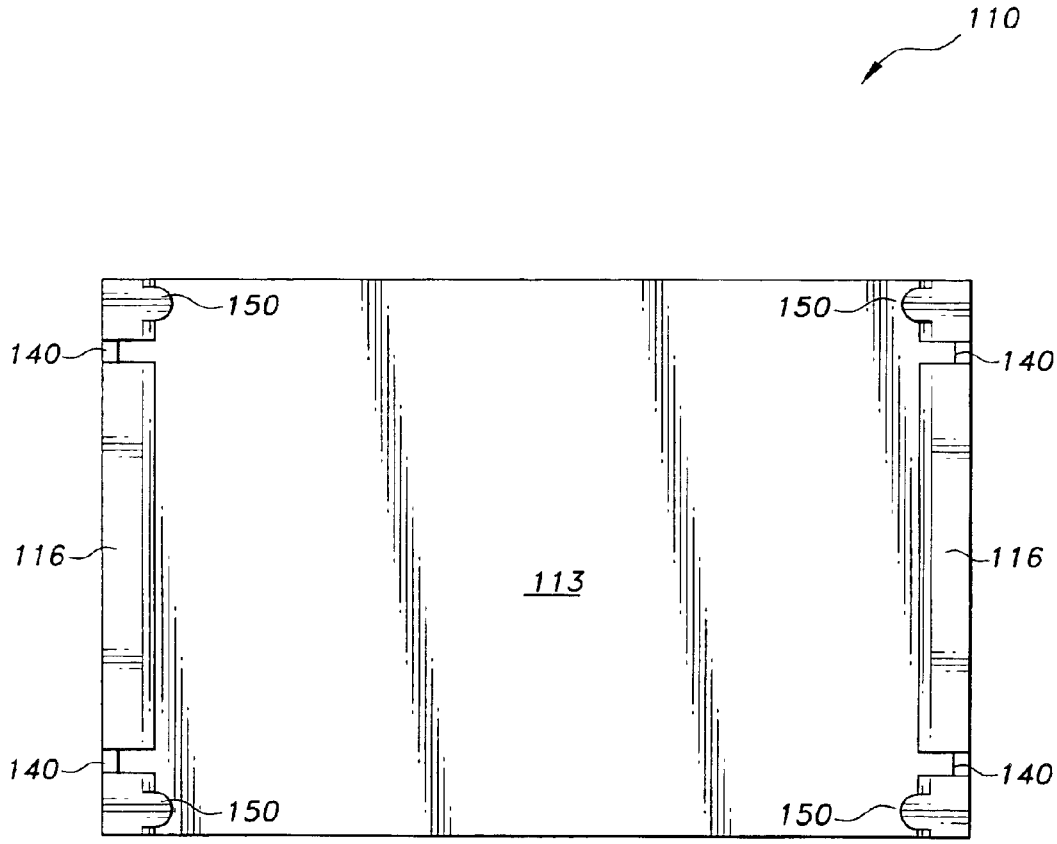
FIG. 9 is a bottom plan view of the housing of the preferred writing pad attachment.

According to another aspect of the preferred embodiment, the writing pad attachment 100 comprises a locking mechanism for securing the support tray in either the closed position (FIG. 7) or the open position (FIG. 8). FIG. 9 is a bottom view of the housing 110. The housing 110 comprises a plurality of lock projections 150 disposed along the lip portions 116. Preferably, the housing 110 comprises one lock projection 150 in each of the four corners of the housing 110.

Figure 11:
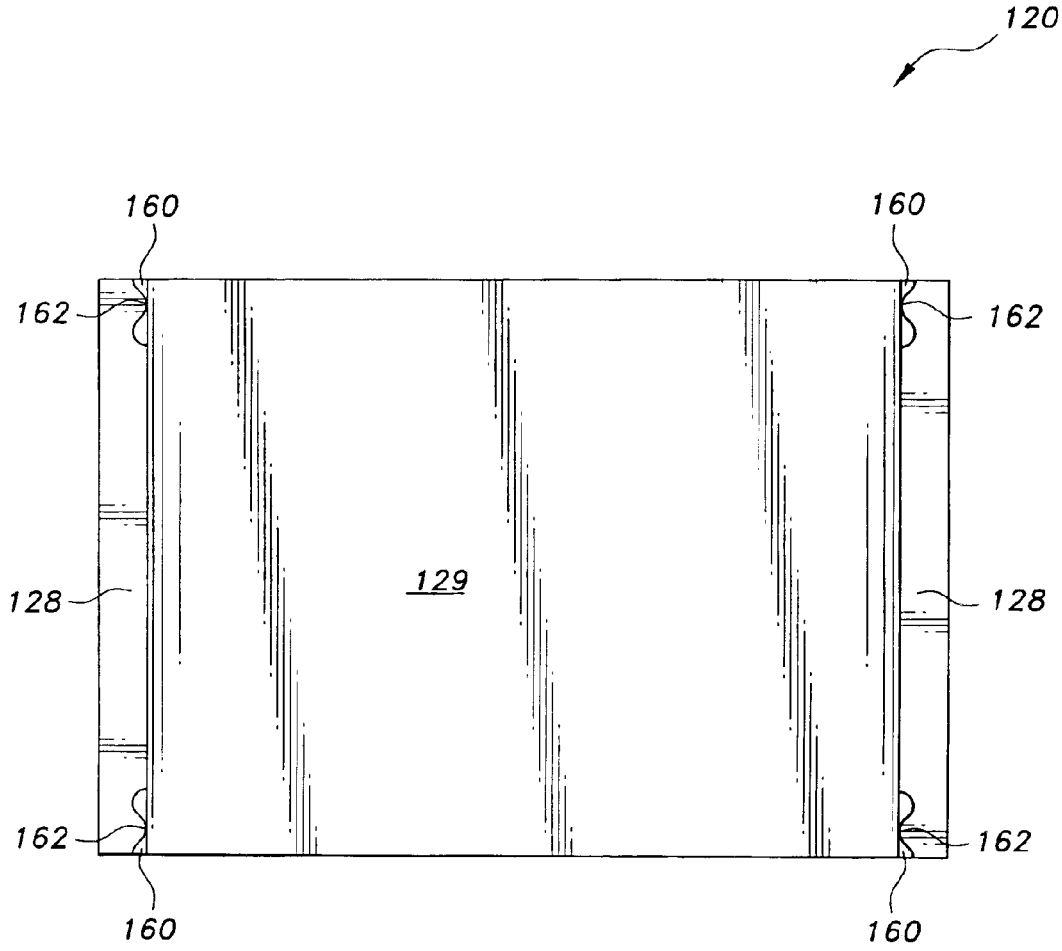
FIG. 11 is bottom plan view of the tray of the preferred writing pad attachment.

FIG. 11 is a bottom view of the support tray 120. The support tray 120 comprises a plurality of lock recesses 160 that are adapted for receiving the lock projections 150 on the housing 110. The lock recesses 160 are disposed along the grooves on either side of the bottom surface 129 of the support tray 120, adjacent the projection portions 128. The position of the lock recesses 160 is further depicted in FIG. 10. Preferably, the support tray 120 comprises a lock recess 160 in each corner of the support tray 120. Each of the lock recesses 160 includes a recessed or indented receiving portion 162 that releasably receive the lock projections 150.

Figure 12A:
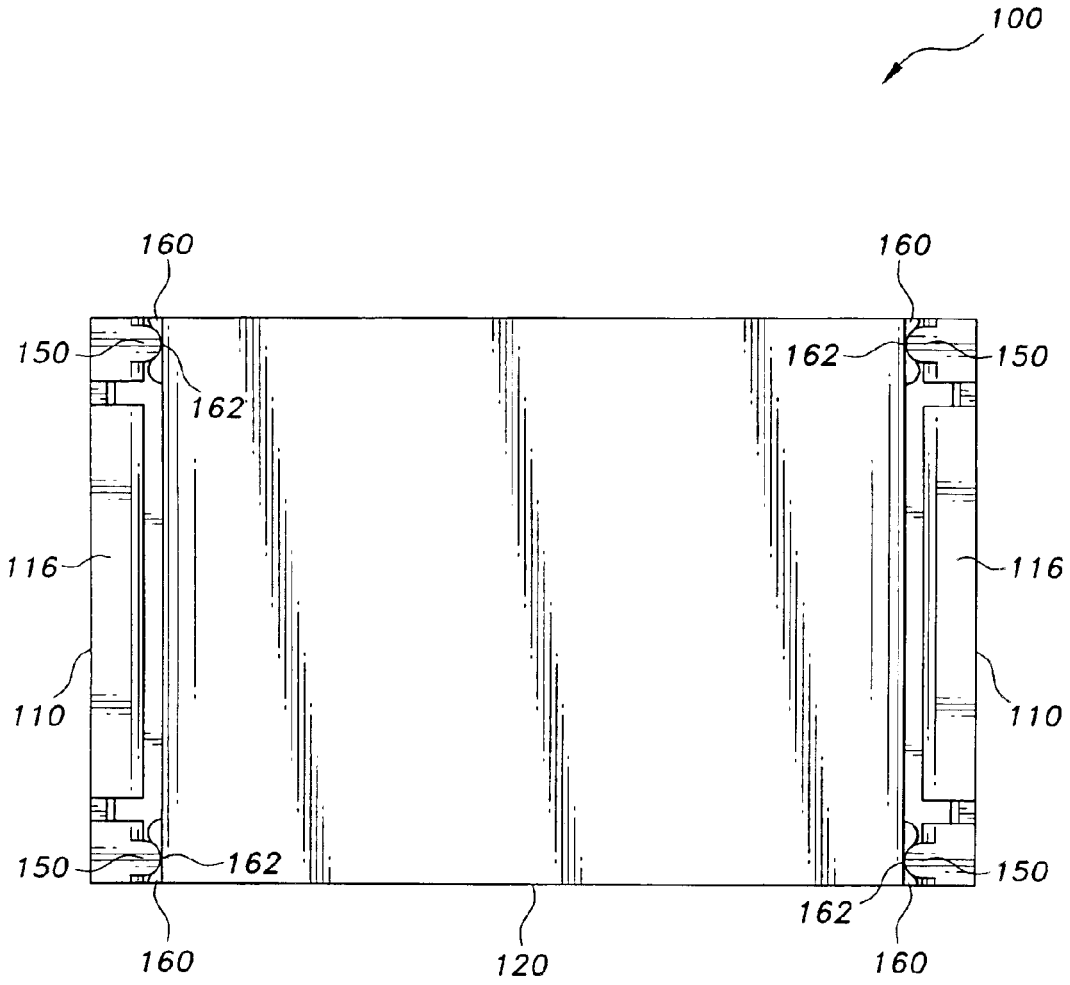
FIG. 12A is a bottom plan view of the preferred embodiment of the writing pad attachment in a closed position.
Figure 12B:
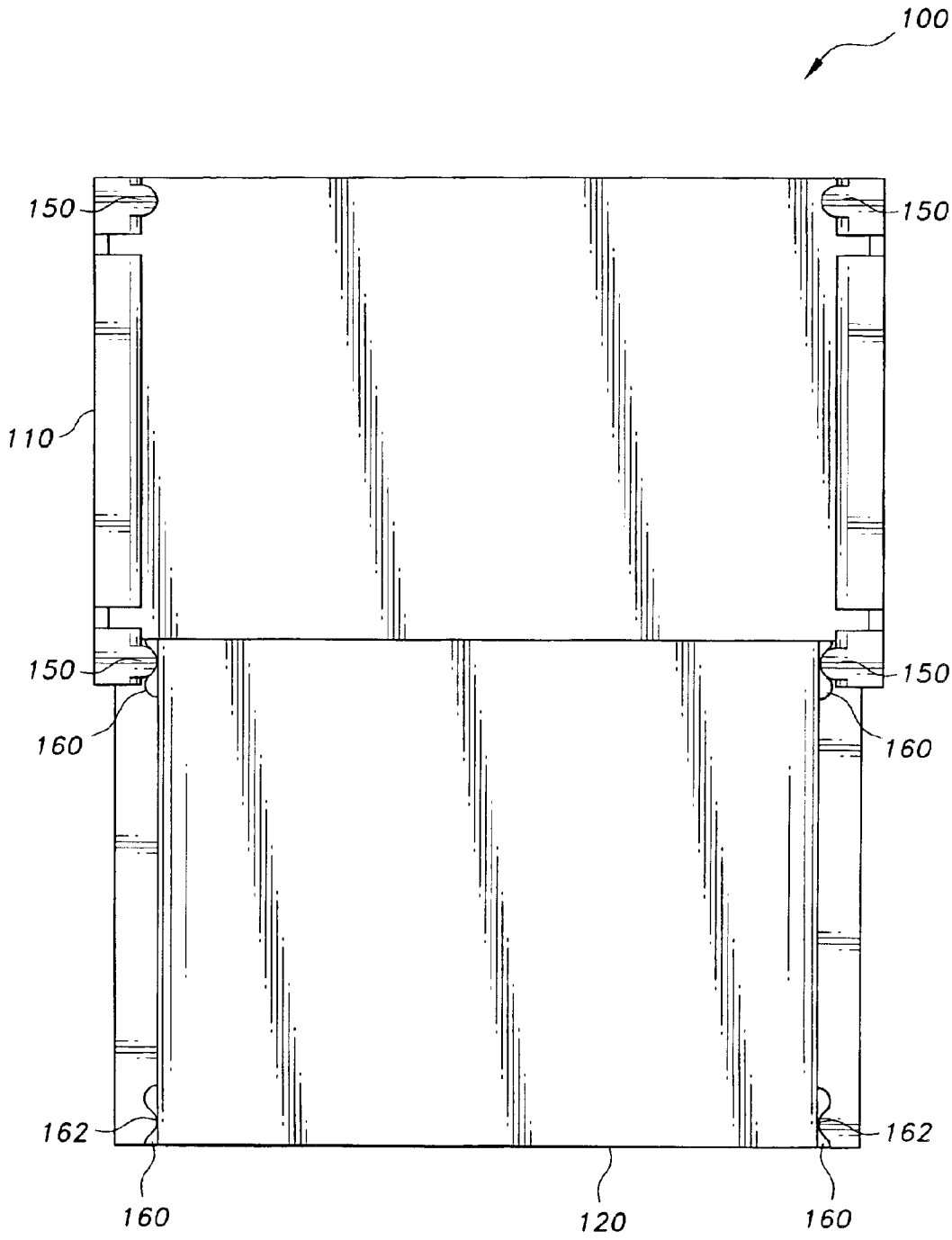
FIG. 12B is a bottom plan view of the preferred embodiment of the writing pad attachment in an open position.

FIGS. 12A and 12B are bottom views of the writing pad attachment 100 depicting the support tray 120 in the closed position and the open position, respectively. In the closed position, as shown in FIG. 12A, all of the lock projections 150 are releasably secured by the lock recesses 160. This prevents the support tray 120 from undesirably sliding out of the closed position. In the open position, as shown in FIG. 12B, only two of the lock projections 150 are secured by the lock recesses 160. The two secured lock projections 150 prevent the support tray 120 from completely releasing from the housing 110.

To adjust the support tray 120 from the closed position to the open position the user of the writing pad attachment 100 must applying a force to the support tray 120 to cause it to slide along the lip portions 116 of the housing 110. The housing 110 comprises a flexibility enhancer for reducing the amount of force necessary to release the lock projections 150 from the lock recesses 160. The flexibility enhancer 140 increases the flexibility of the housing 110 so that the lock projections 150 may easily be released from the lock recesses 160. According to the preferred embodiment of the present writing pad attachment 100, the flexibility enhancer comprises a plurality of slots 140 disposed along the closed sides 114 of the housing 110.

It is to be understood that the present invention is not limited to the embodiments described above, but encompasses any and all embodiments within the scope of the following claims.

We claim:

1. A writing pad attachment for a wireless communication device comprising:

a housing, releasably mountable to a wireless device, the housing having at least a top surface, at least two closed sides forming an access opening in said housing, and a bottom lip portion disposed along each of said closed sides;

an adjustable support tray slidably disposed in said housing and supported by said bottom lip portions, the support tray having a main body with a top surface, a bottom surface and a pair of mounting grooves disposed on a first side and a second side of the bottom surface for slidably engaging said bottom lip portions, the support tray being movable between at least two positions through the access opening, wherein the at least two positions include an open position and a closed position;

a support tray locking mechanism for releasably locking said support tray in one of the at least two positions;

a marking pad removably disposed in said support tray; and a writing implement removably disposed in said support tray;

wherein the top surface of said support tray comprises a plurality of side walls forming an indented receiving portion for receiving and storing said marking pad and said writing implement, wherein the side walls retain said marking pad and said writing implement in the receiving portion.

2. The writing pad attachment according to claim 1, further comprising a mounting member for releasably mounting the writing pad attachment to a wireless communication device.

3. The writing pad attachment according to claim 2, wherein said mounting member is disposed along the top surface of said housing for securing said housing to a rear portion of a wireless communication device.

4. The writing pad attachment according to claim 2, wherein said mounting member is double-sided adhesive tape.

5. The writing pad attachment according to claim 1, wherein said housing and said support tray are fabricated from a lightweight material.

6. The writing pad attachment according to claim 1, wherein said support tray locking mechanism comprises:

a plurality of lock projections, one of said lock projections disposed on each end of each of said bottom lip portions on said housing; and a plurality of lock recesses, adapted for releasably receiving said lock projections, disposed on each end of each mounting groove on the support tray;

whereby said locking recesses releasably receive said locking projections to secure said support tray in at least one of said open position and said closed position, said locking projections releasable from said locking recesses by applying a force to said support tray.

7. The writing pad attachment according to claim 1, further comprising a housing flexibility enhancer for reducing the amount of force needed for locking said support tray in one of the at least two positions and for releasing said support tray from one of the at least two positions.

8. The writing pad attachment according to claim 7, wherein said housing flexibility enhancer comprises a plurality of slots disposed along the closed sides of said housing.

9. The writing pad attachment according to claim 1, wherein the at least two positions further comprise a removable position, such that said support tray is removed from said housing.

10. The writing pad attachment according to claim 1, wherein said marking pad and said writing implement are concealed in the housing when the supporting surface is in the closed position.

11. The writing pad attachment according to claim 1, wherein said marking pad comprises a pad of paper.

12. The writing pad attachment according to claim 1, wherein said writing implement comprises a pen.

13. A writing pad attachment for a wireless communication device comprising:

a housing, releasably mountable to a wireless device, the housing having at least a top surface, at least two closed sides forming an access opening in said housing, and a bottom lip portion disposed along each of said closed sides;

an adjustable support tray slidably disposed in said housing and supported by said bottom lip portions, the support tray having a main body with a top surface, a bottom surface and a pair of mounting grooves disposed on a first side and a second side of the bottom surface for slidably engaging said bottom lip portions, the support tray being movable between at least two positions through the access opening, wherein the at least two positions include an open position and a closed position;

a support tray locking mechanism for releasably locking said support tray in one of the at least two positions;

a marking pad removably disposed in said support tray;

a writing implement removably disposed in said support tray;

a housing flexibility enhancer for reducing the amount of force needed for locking said support tray in one of the at least two positions and for releasing said support tray from one of the at least two positions, said housing flexibility enhancer comprising a plurality of slots disposed along the closed sides of said housing.

* * * * *